US012745849B2

(12) United States Patent
Riviere

(10) Patent No.: US 12,745,849 B2
(45) Date of Patent: Sep. 29, 2026

(54) SYSTEMS AND METHODS FOR MODULAR FURNITURE

(71) Applicant: Edouard Jean Riviere, Santa Monica, CA (US)

(72) Inventor: Edouard Jean Riviere, Santa Monica, CA (US)

( * ) Notice: Subject to any disclaimer, the term of this patent is extended or adjusted under 35 U.S.C. 154(b) by 115 days.

(21) Appl. No.: 18/804,877

(22) Filed: Aug. 14, 2024

(65) Prior Publication Data

US 2025/0057318 A1 Feb. 20, 2025

Related U.S. Application Data

(60) Provisional application No. 63/519,545, filed on Aug. 14, 2023.

(51) Int. Cl.

| | |
|---|---|
| ***A47C 13/00*** | (2006.01) |
| ***A47C 17/02*** | (2006.01) |
| ***A47C 31/10*** | (2006.01) |

(52) U.S. Cl.

CPC ..... *A47C 13/005* (2013.01); *A47C 17/02* (2013.01); *A47C 31/10* (2013.01)

(58) Field of Classification Search

CPC ..... A47C 13/005; A47C 17/02; A47C 31/10; A47C 4/028; A47C 7/42; A47C 31/11

See application file for complete search history.

(56) References Cited

U.S. PATENT DOCUMENTS

| | | | | |
|---|---|---|---|---|
| 4,209,198 | A * | 6/1980 | Apple, Sr. | A47C 4/02 297/448.1 |
| 4,305,616 | A * | 12/1981 | Martinez | A47C 4/028 297/411.27 |
| 6,796,614 | B1 * | 9/2004 | Paul | A47C 7/42 297/118 |
| 7,438,362 | B2 * | 10/2008 | Dotta | A47C 7/28 297/452.52 |
| 9,560,916 | B1 * | 2/2017 | Bullard | A47C 7/28 |
| 10,548,401 | B2 | 2/2020 | Clabots | |
| 11,672,351 | B2 | 6/2023 | Clabots | |
| 2012/0248834 | A1 * | 10/2012 | Whidden | A47C 13/005 297/411.27 |
| 2015/0137576 | A1 * | 5/2015 | Bullard | A47C 3/00 297/452.18 |
| 2017/0055710 | A1 * | 3/2017 | Sewell | A47C 4/028 |
| 2017/0347799 | A1 * | 12/2017 | Sewell | A47C 4/028 |
| 2020/0260875 | A1 * | 8/2020 | Nelson | B68G 5/00 |

(Continued)

*Primary Examiner* — J. T. Newton

(74) *Attorney, Agent, or Firm* — CIONCA IP Law P.C.

(57) ABSTRACT

Provided herein are systems and methods for modular furniture, for assembling a furniture unit into a desired configuration, having a plurality of modules, wherein each one of the modules is configured to fit with any one of each of the other modules, having: a plurality of horizontal modules, each one of the horizontal modules comprising: a horizontal frame; and at least one horizontal frame mating plate; a plurality of vertical modules, each one of the vertical modules comprising: a vertical frame; and at least one vertical frame mating plate; wherein the horizontal frame mating plate and the vertical frame mating plate of each one of the horizontal modules and each one of the vertical modules are capable of connecting and securing to a second horizontal frame mating plate or a second vertical frame mating plate.

20 Claims, 13 Drawing Sheets

(56) References Cited

U.S. PATENT DOCUMENTS

| | | | | |
|---|---|---|---|---|
| 2020/0260880 | A1* | 8/2020 | Nelson | A47C 19/027 |
| 2020/0268160 | A1* | 8/2020 | Kuhl | A47C 17/86 |
| 2021/0000258 | A1 | 1/2021 | Nelson et al. | |
| 2021/0251387 | A1* | 8/2021 | Milberg | A47C 13/005 |
| 2022/0000266 | A1* | 1/2022 | Nelson | A47C 4/028 |
| 2022/0408929 | A1 | 12/2022 | Gansow et al. | |
| 2023/0038420 | A1* | 2/2023 | Eglinton | A47C 4/02 |
| 2024/0341486 | A1* | 10/2024 | Aubé | A47C 13/005 |
| 2024/0415290 | A1* | 12/2024 | Aubé | A47C 13/005 |
| 2025/0057318 | A1* | 2/2025 | Riviere | A47C 4/028 |

* cited by examiner

SYSTEMS AND METHODS FOR MODULAR FURNITURE

CROSS-REFERENCE TO RELATED APPLICATIONS

This application claims the benefit of U.S. Provisional Application No. 63/519,545, filed Aug. 14, 2023, which is hereby incorporated by reference, to the extent that it is not conflicting with the present application.

BACKGROUND OF INVENTION

1. Field of the Invention

The invention relates generally to furniture, and more specifically to modular furniture.

2. Description of the Related Art

Generally, furniture such as sofas are delivered to a user in a single piece, with all parts attached to the frame of the sofa. This can pose several problems, such as, for example, lack of selection or long delivery lead times due to specific desired configurations being only available through a custom order. Such custom orders may often not be eligible for returns or cancelations. Additionally, delivery of furniture may only be possible through certain select carriers which can be slow, expensive, offer poor tracking, and only able to deliver on appointment. Further problems with existing furniture options are that, when a piece of furniture is only available in a single piece, damage, even small amounts of damage, can ruin the entire piece of furniture. In addition to the above problems regarding custom orders, in most cases existing pieces of furniture can no longer be upgraded or modified to suit changing needs. For example, additional seats cannot be changed, and covers and colors cannot be changed. Large furniture can also be bulky and difficult to move, and users may at times be unable to move the furniture, and users can be forced to sell or discard the item.

In some existing furniture systems, covers made of leather for the sofa frame (i.e., for the seating area, backrest, armrest portions) are not removable from the sofa frame. This is because existing designs generally rely on the user to set the tension on the fabric, attaching the cover manually to the frame with closure such as Velcro. With Velcro, the cover cannot be spread over the entire frame with even tension, so the cover may be wrinkled. The system of using Velcro to secure and tension a cover onto a sofa frame can be suitable for certain fabric types, but may be unsuitable for leather, for example. Therefore, leather cover options are generally not removable from sofa frames, and generally are stapled to the sofa frame, making the customizability and modification options limited for the user.

Existing modular sofa designs having removable covers are generally based on the concept of "pods," i.e., individual seat units with four feet, to which armrests and backrests are attached. They have a large number of feet, and all pieces must be touching the ground, providing limited design options. These generally also have a distinctive "sofa in a box" appearance due to the large number of feet. Existing modular sofa designs having fewer feet generally do not have removable covers, because the feet system prevents the users from removing the covers.

Existing modular sofa designs may be environmentally harmful because not every component that wears down over time is easily serviceable. At least one component of the suspension system (such as webbing, springs, and so on), foam, and upholstery of a piece of furniture is generally permanently adhered to the framework of the furniture, requiring work by professional upholsterers and the like in order for repairs or replacements to be done. Generally, it may be financially burdensome for a user to service a piece of furniture or replace or repair only a small portion of the furniture. Therefore, many users may discard the entire furniture unit, adding tons of perfectly functional metal or wood frames to landfills.

Therefore, there is a need for a solution to the above problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description.

In some embodiments, a system for modular furniture is provided, wherein numerous configurations of a furniture unit made up of modular pieces ("modules," "modular pieces," or "module pieces") are possible using a limited number of modules. In some embodiments, the furniture unit is a sofa. In some embodiments, the limited number of modules can be held in stock for sale to a user, which can help to decrease lead times. Modules can ship in boxes, and can be shipped via any existing delivery service, such that delivery can be fast, and tracking can be provided to the user, which can also help to limit the risk of damage to the furniture units or modular pieces. In such embodiments, individual modules of a furniture unit can be replaced, such that the furniture units can be reconfigured, expanded, or changed as needed. The furniture units can also easily and efficiently be broken down into the modular pieces for ease of moving the furniture unit.

Provided herein are systems and methods for modular furniture, for assembling a furniture unit into a desired configuration, having a plurality of modules, wherein each one of the modules is configured to fit with any one of each of the other modules, having: a plurality of horizontal modules, each one of the horizontal modules comprising: a horizontal frame; and at least one horizontal frame mating plate; a plurality of vertical modules, each one of the vertical modules comprising: a vertical frame; and at least one vertical frame mating plate; wherein the horizontal frame mating plate and the vertical frame mating plate of each one of the horizontal modules and each one of the vertical modules are capable of connecting and securing to a second horizontal frame mating plate or a second vertical frame mating plate.

In some embodiments, a system for modular furniture is provided, wherein the furniture units made up of modular pieces can be used with covers. The covers can be constructed from any suitable material. In such embodiments, each upholstered modular piece can function similarly to a cushion, wherein the frame of the piece is fully wrapped by the cover, and the cover can be closed around the frame. The closure may be by using a zipper or any other suitable closure method. In such embodiments, the tension of the upholstery material of the cover may be provided by inner foam and batting.

In some embodiments, a system for modular furniture is provided, wherein furniture units are made up of modular pieces, and wherein the modular pieces comprise separate frames for horizontal support and vertical support. In some embodiments, the vertical support frames are attached on top of horizontal support frames via a coupling system, instead of resting directly on the ground or other surface. The coupling system provides a means for attaching the horizontal and vertical support frames together such that the number of feet can be reduced, and such that the vertical frames are fully upholstered. Therefore, the furniture unit, which can be a sofa, is provided with an appearance of a non-modular sofa. The coupling system can allow a user to easily customize the design of the sofa to suit different needs.

In some embodiments, the horizontal support frame of a module comprises a suspension system and feet for the furniture unit that the module builds. In some embodiments, the horizontal support frame is not upholstered, and the vertical support frame is provided having upholstery. In some embodiments, a coupling system is provided for the modular furniture system such that covers are removable and can be constructed from any material, such as leather.

In some embodiments, the system for modular furniture can be used to create both indoor and outdoor versions of a sofa, wherein the indoor version and the outdoor version are constructed from different materials according to the environment in which the furniture unit is to be used. For example, frames may be constructed from stainless steel, covers may be made of ultraviolet-resistant and water-resistant material, and marine-grade foam may be provided for outdoor use.

In some embodiments, the system for modular furniture comprises furniture units that can be fully serviced by the user. As an example, the modular furniture may comprise covers that are fully removable due to not being glued or stapled to the frame or foam of the furniture. The modular furniture may also be provided with dust covers or other covers that are not permanently attached to the frames of the furniture modules. The foam of the furniture modules may also be fully removable, due to not being glued or stapled to the frame or the covers. In some embodiments, the system for modular furniture is provided with a suspension system. In such embodiments, the suspension system comprises webbing held in place with hooks, or any other suitable attachment points, wherein the elements of the suspension system are easily replaceable using common or simple tools. In some embodiments, the furniture modules comprise fasteners such as bolts and nuts that can be replaced by a user using common or simple tools.

In some embodiments, the modules of the modular furniture systems provided herein comprise support frames constructed from mild steel. An advantage may be that the furniture unit built using the modules may be significantly lighter than another sofa of similar dimensions constructed from wood. The steel may also provide more compact dimensions of the modules for reducing shipping costs and emissions.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
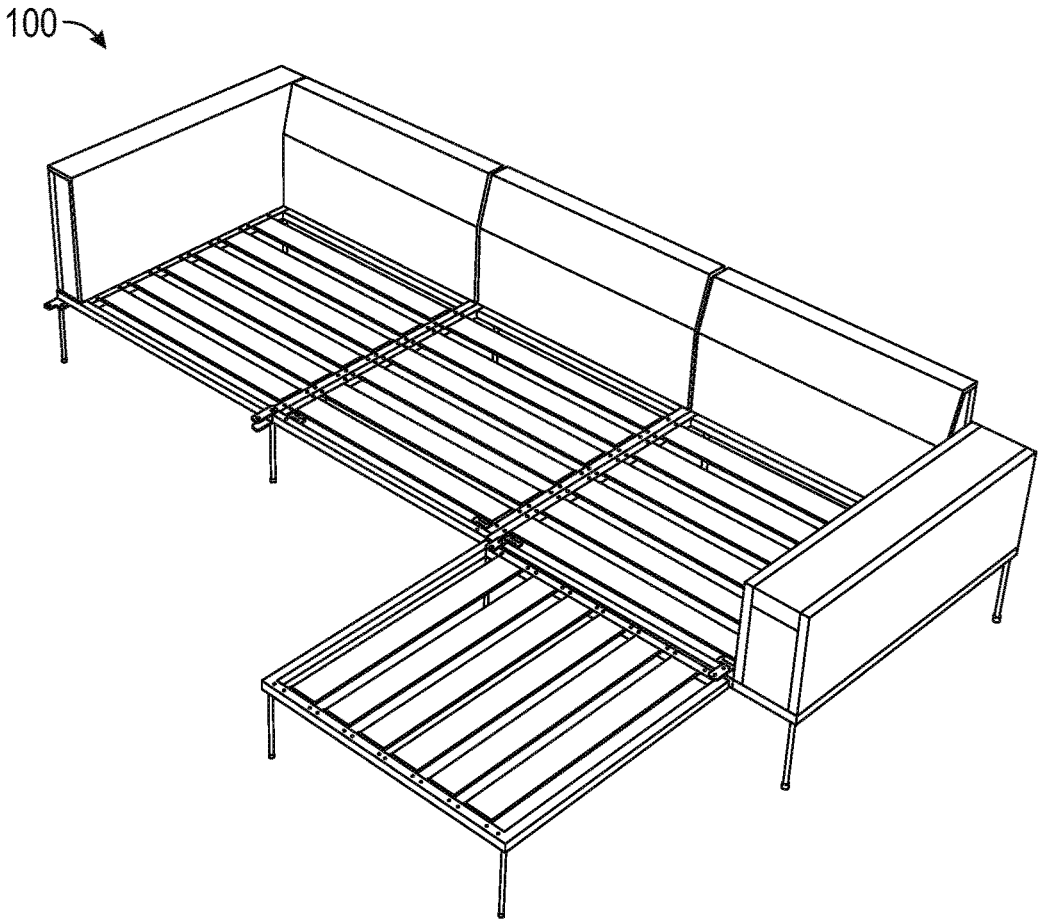
FIG. 1 depicts a top, side perspective view of an exemplary furniture unit assembled using modules of a modular furniture system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

FIG. 1 depicts a top, side perspective view of an exemplary furniture unit 100 assembled using modules of a modular furniture system, according to an aspect. In the example shown in FIG. 1, the furniture unit is a sofa. It should be understood that modular furniture systems provided herein can generally be used for building any other suitable types of furniture.

Figure 2A:
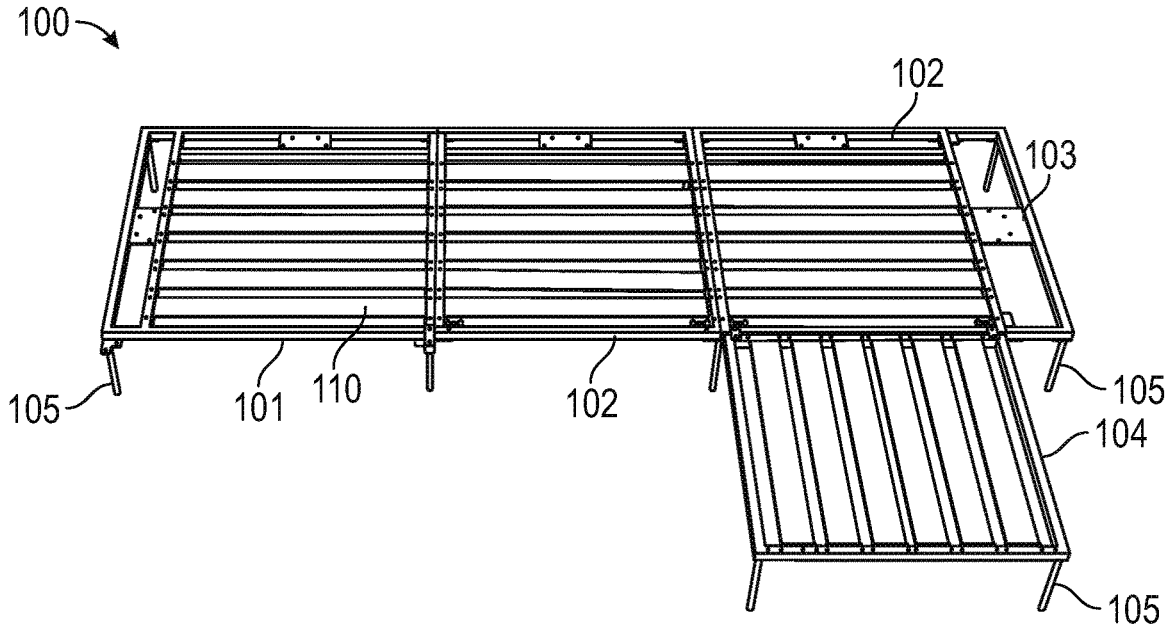
FIG. 2A depicts a top, front perspective view of a plurality of modules of a modular furniture system, assembled together to create a horizontal framework of a sofa, according to an aspect.

FIG. 2A depicts a top, front perspective view of a plurality of modules of a modular furniture system, assembled together to create a horizontal framework of a sofa, according to an aspect. The modules shown in FIG. 2 comprise horizontal support frames, and are connected together to form a single horizontal support frame structure for a sofa. The horizontal modules shown include a corner unit 101, two seat units 102, a chaise unit 104, and an armrest unit 103 in an exemplary configuration. These modules also comprise feet 105. Seat units 102 may be chained next to each other with no limit on the number of units. For example, two-seater, three-seater, or four-seater units, and so on, may be created. An armrest unit 103 may be added to a left or right side or both sides of a seat unit. A corner unit 101 may be placed on either or both sides of a seat unit to create L-shaped or U-shaped sofas. A chaise unit 104 can be placed in front of a seat unit or chained with a second chaise unit to create sectional sofas. Each module may comprise a horizontal support frame 110 (also referred to herein as a "suspension system"), which may be made up of a plurality of flat bars constructed from steel or any other suitable material, and may comprise elastic webbing constructed from rubber and polypropylene thread or any other suitable material.

Figure 2C:
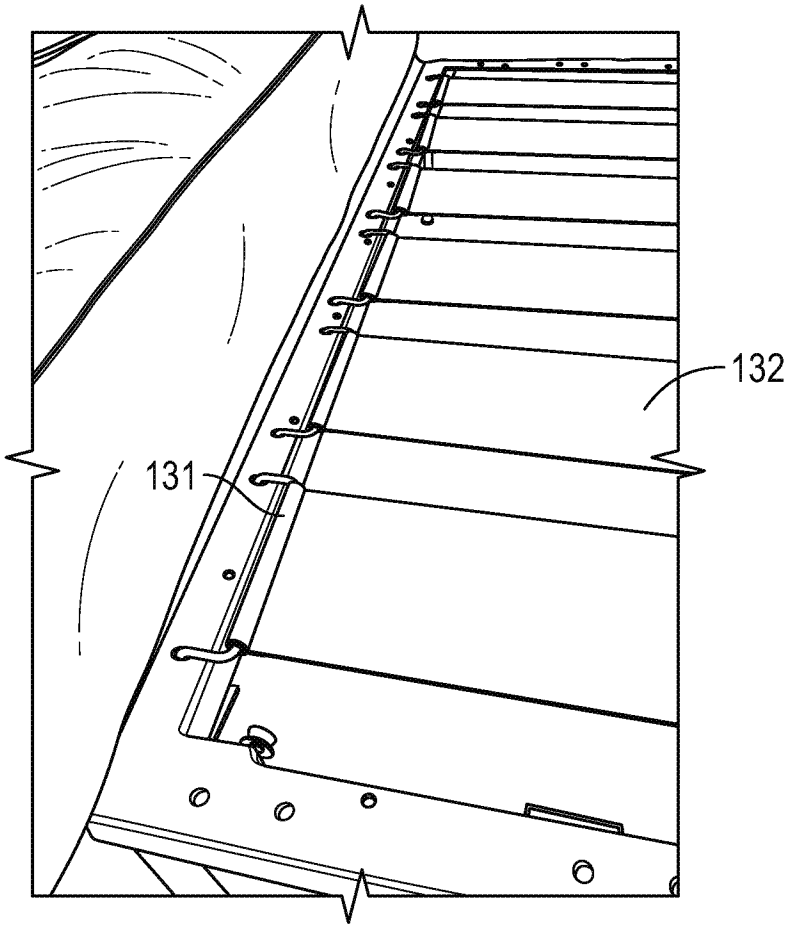
FIGS. 2B-2C depict a top view and a partial top perspective view, respectively, of the suspension system of a seat unit module, according to an aspect.
Figure 2B:
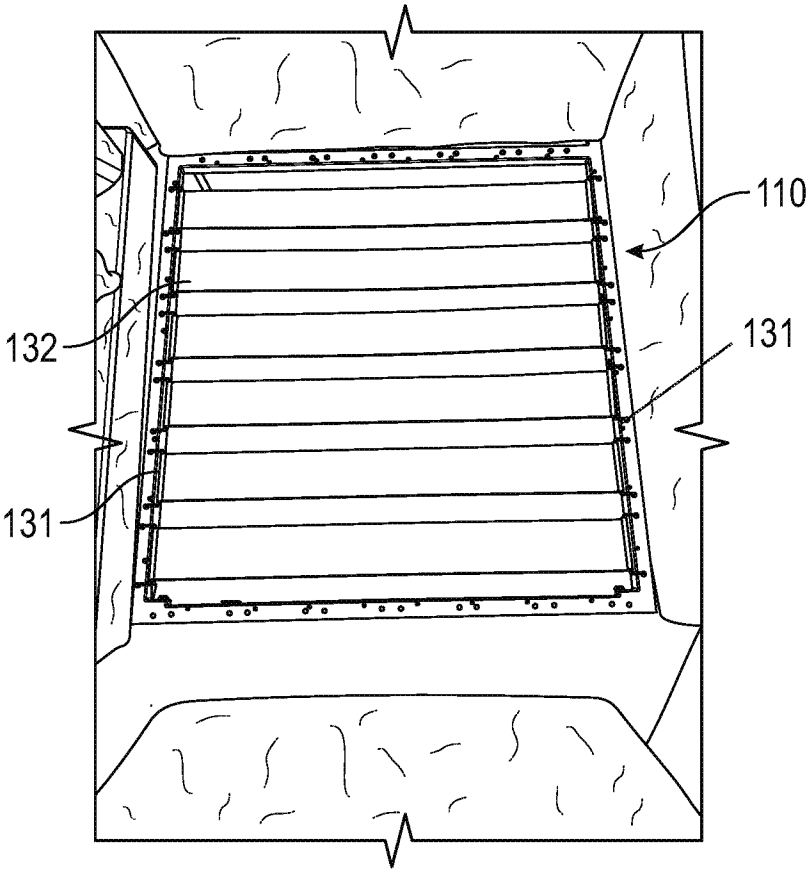

FIGS. 2B-2C depict a top view and a partial top perspective view, respectively, of the suspension system 110 of a seat unit module, according to an aspect. In some embodiments, each horizontal frame module is provided with a suspension system, The suspension system may comprise straps 132 constructed from elastic webbing, having double hooks 131 on both ends. In some embodiments, the suspension system comprises six straps on a single module. In some embodiments, the suspension system is configured to support the weight of the seats placed on the system, and the weight of a user seated on the furniture unit.

In some embodiments, the horizontal modules are uncovered, as shown in FIGS. 2B-2C. The modular furniture systems provided herein comprise seat cushions which may be placed directly on the seats, which are shown as being empty in FIGS. 2B-2C. The straps 132 may be designed to support the seat cushions directly, and may be spaced out per various manufacturer's specifications, for example. Generally, an advantage may be that the appearance is more desirable for some users, and there is no upholstery material on the frame that can wear out or become dirty. Further, the horizontal frame being uncovered provides easier access to the wingnuts or other fastening means that is used for assembling together the modules.

In some embodiments, the feet of the modular furniture systems provided herein are removable and customizable. The feet may be of various lengths, shapes, and material. Because the framework of the modular furniture systems provided herein generally are constructed from mild steel, which is stiffer than wood, the frames can be slimmer than those constructed of wood (such as, for example, approximately 1 inch thick) and can be positioned as high or low off of the ground as desired by a user.

Figure 3:
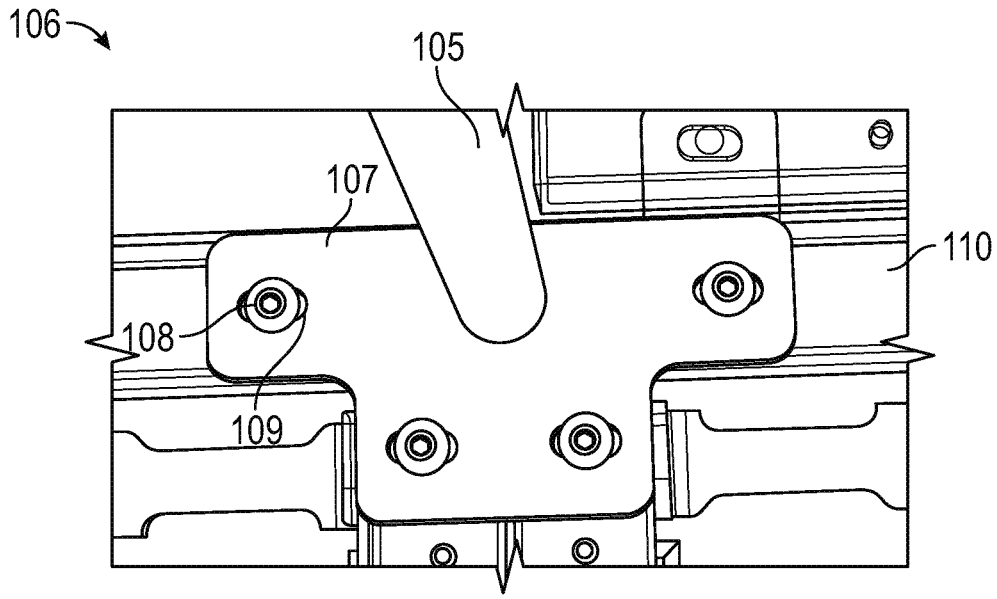
FIG. 3 depicts a bottom view of a portion of a coupling system used for attaching modules together, provided on an underside of the horizontal support frame, according to an aspect.

FIG. 3 depicts a bottom view of a portion of a coupling system 106 used for attaching modules together, provided on an underside of the horizontal support frame 110, according to an aspect. The coupling system comprises a plate 107 (also referred to herein as "bracket") and bolts 108 used for attaching the plate to the frames. It should be understood that the plates 107 may be provided in various shapes according to where the plates are provided on a module. For example, a plate may be provided with a flat shape or with a bent shape, according to its placement on a module. In some embodiments, the plates are constructed from sheet metal. The plate 107 may be welded onto the foot 105 which extends downwards from the plate to the ground or other surface. In some embodiments, the plate 107 is provided with a four-hole pattern such as the example depicted. The holes 109 for receiving bolts 108 may be threaded holes.

Figure 4A:
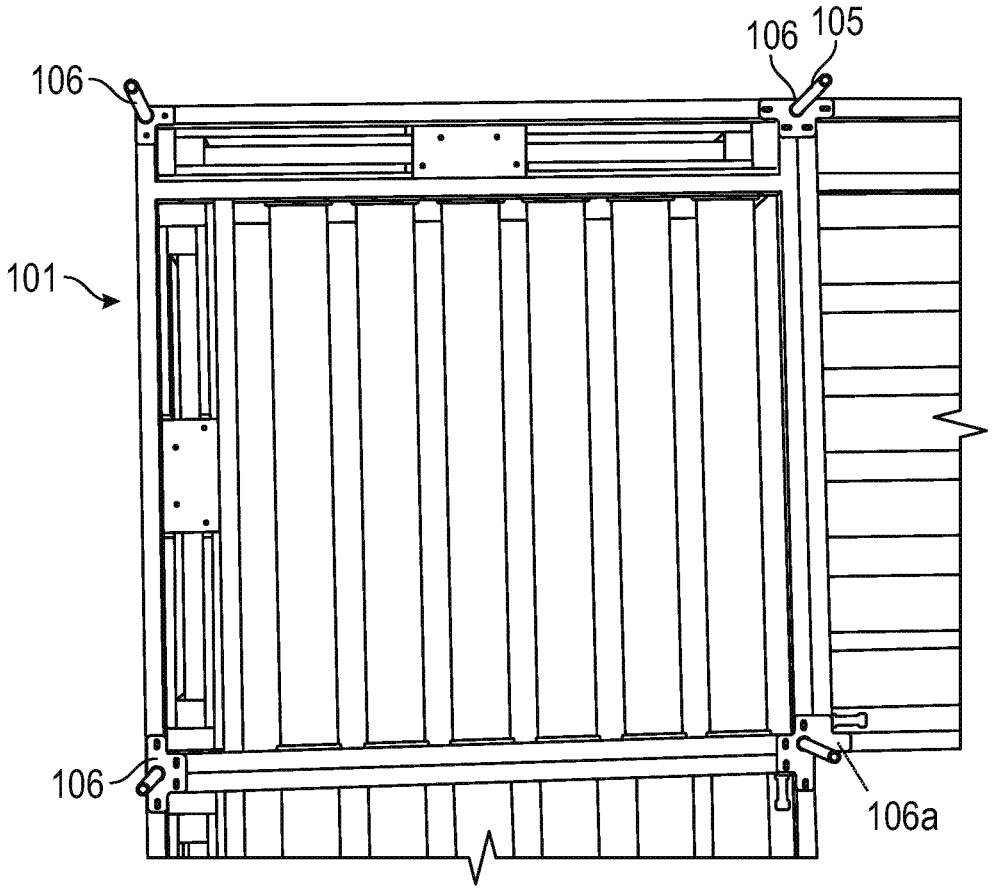
FIGS. 4A-4B depict a bottom view and a top view, respectively, of a portion of a corner unit, showing the coupling system at various portions of the unit, according to an aspect.
Figure 4B:
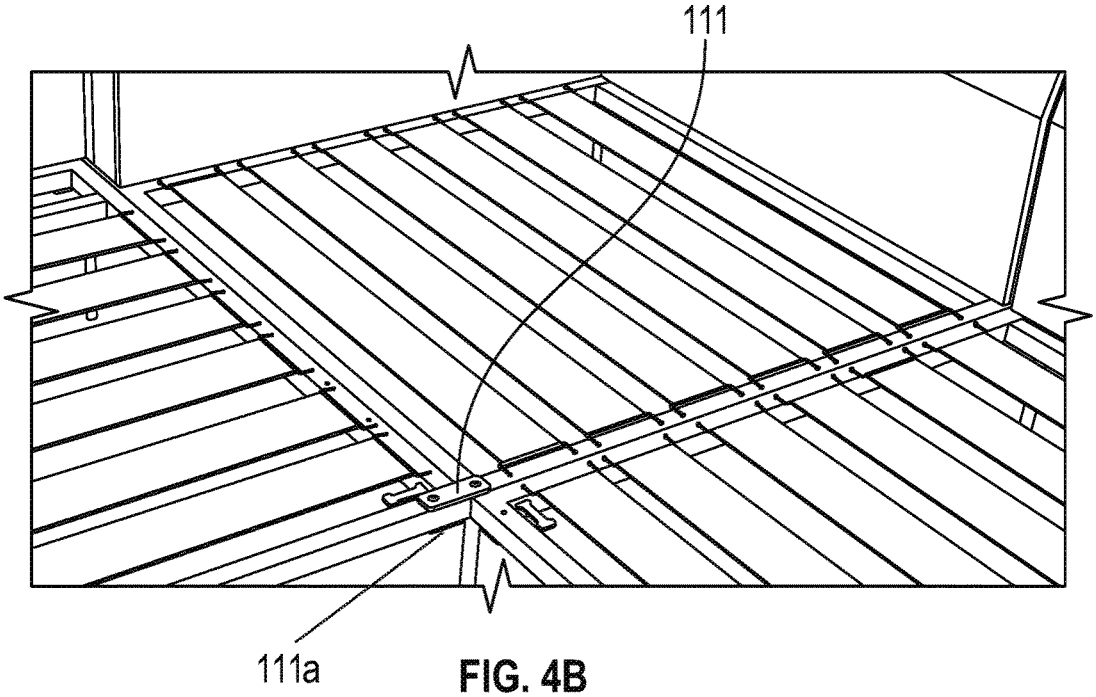

FIGS. 4A-4B depict a bottom view and a top view, respectively, of a portion of a corner unit 101, showing the coupling system 106 at various portions of the unit, according to an aspect. Corner units may be bolted to seat units, for example, using the coupling system shown and described when referring to FIG. 3. The coupling systems for attaching a corner unit to a seat unit may be provided on the back of the sofa. In some embodiments, coupling systems provided for use throughout the modular furniture systems disclosed herein may consistent or the same throughout the system. For example, each coupling system may have the same feet and hole pattern. In some embodiments, some coupling systems used in the modular furniture systems disclosed herein may contain differences, such as having no holes one side, as seen by 106*a*. A specific bracket ("top bracket") 111 may be provided on the front corner for bolting on top of the frames. Generally, three attachment points may be provided for assembling together certain modules. In some embodiments, three modules are assembled together, which may be accomplished by providing more than one plate at the bottom. Therefore, in such embodiments, additional brackets such as a top bracket 111 having adjustability in two directions may be provided. This top bracket 111 having adjustability may be able to compensate for any misalignments. Additionally, due to the holes being oval instead of round, may assist in attaching the second seat unit from the front of the furniture unit. The top bracket 111 may help to address the issue of the positioning of the holes, due to 1) the precision of the measurements for indicating where to drill, and 2) the precision of the drilling itself, i.e., whether the hole is drilled exactly on the positioning mark. In some embodiments, tolerances are provided for both 1) and 2), with 1) being the largest, because the frames are large (e.g., 1/16" out of 30" is approximately 0.002"), and because the position of the holes will be determined from a reference point (e.g., the front right corner of the frame), so the tolerances of the frame dimensions trickle down to the positioning of the holes. In some embodiments, such as the example depicted in FIG. 4B, the top bracket 111 may differ from a bottom bracket wherein the bottom bracket 11*a* does not have holes at the bottom side.

Figure 5A:
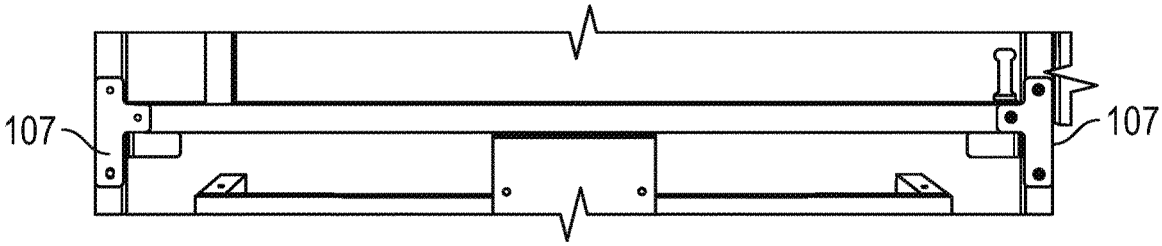
FIG. 5A depicts a bottom view of an armrest unit, showing brackets at left and right sides of the armrest, according to an aspect.

FIG. 5A depicts a bottom view of an armrest unit 103, showing brackets 107 at left and right sides of the armrest, according to an aspect. An armrest unit 103 may be provided with two brackets 107 as shown, and these may be bolted to other modules using the same hole patterns as shown and described when referring to FIG. 3.

Figure 5B:
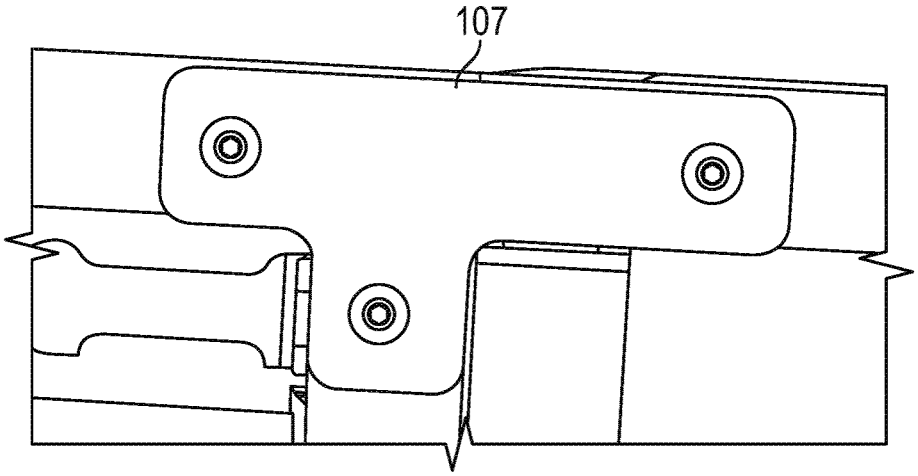
FIG. 5B depicts an enlarged detailed view of a bracket provided on the underside of an armrest unit, according to an aspect.

FIG. 5B depicts an enlarged detailed view of a bracket 107 provided on the underside of an armrest unit, according to an aspect.

Figure 5C:
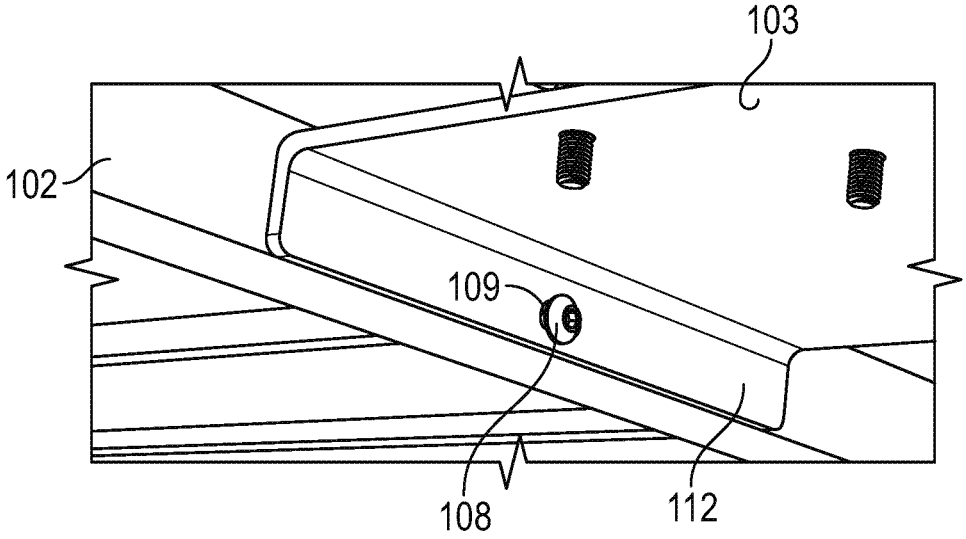
FIG. 5C depicts a bottom perspective view of a coupling system showing coupling of a seat unit with an armrest unit, according to an aspect.

FIG. 5C depicts a bottom perspective view of a coupling system showing coupling of a seat unit 102 with an armrest unit 103, according to an aspect. The armrest unit may be provided with a mating plate 112 which extends downward from the armrest at approximately a 900 angle (that is, having a horizontal portion and a vertical portion, which are approximately perpendicular to each other) and attaches to the seat unit. The securing between the two units may be accomplished by a bolt 108 through a threaded hole 109.

In some embodiments, the brackets 107 at a left side and a right side of an armrest unit, as shown as an example in FIG. 5A, provide two points of attachment for connecting the armrest unit to another module, such as a seat unit, and the mating plate 112 provides a third point of attachment.

Figure 6A:
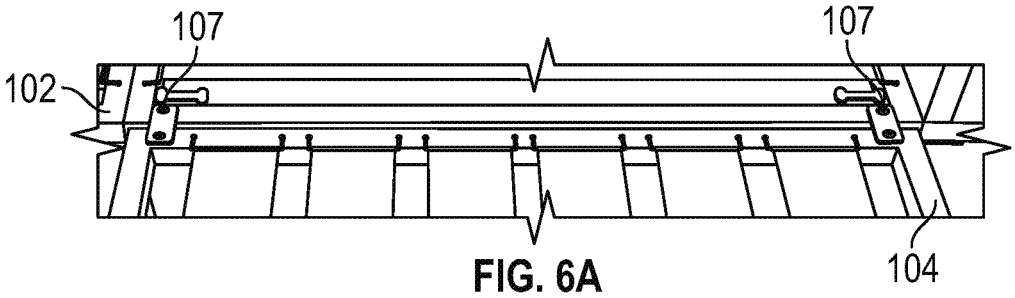
FIGS. 6A-6B depict a top perspective view of a coupling system showing coupling of a chaise unit to a second exemplary unit, and an enlarged detailed view of one of the brackets of the coupling system, respectively, according to an aspect.
Figure 6B:
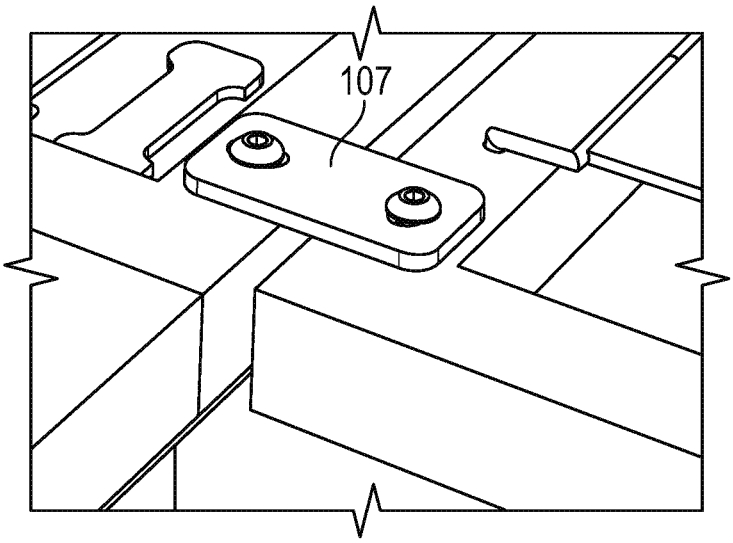

FIGS. 6A-6B depict a top perspective view of a coupling system showing coupling of a chaise unit 104 to a second exemplary unit 102, and an enlarged detailed view of one of the brackets 107 of the coupling system, respectively, according to an aspect. In some embodiments, the second unit is a chaise unit, or a seat unit. In some embodiments, chaise units are attached to other chaise units or seat units with two brackets 107, each having two bolts, wherein the brackets 107 are situated on a top side of the frames.

Figure 7A:
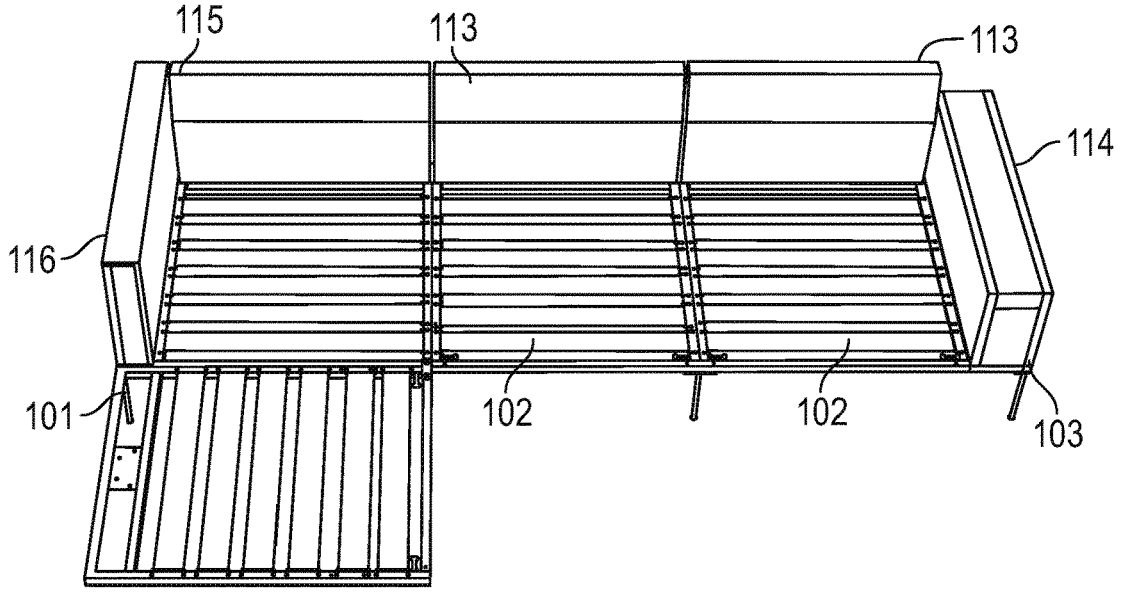
FIG. 7A depicts a top, front perspective view of a plurality of modules of a modular furniture system, assembled together to create a horizontal framework and a vertical framework of a sofa, according to an aspect.

FIG. 7A depicts a top, front perspective view of a plurality of modules of a modular furniture system, assembled together to create a horizontal framework and a vertical framework of a sofa, according to an aspect. The vertical frames of the plurality of vertical modules of the modular furniture system, creating the vertical framework, may include the following vertical units: seat backs 113 for attaching onto seat units 102, an armrest 114 for attaching onto an armrest unit 103, an angled corner back 115 and a straight corner back 116 for attaching onto a corner unit 101. The angled corner back 115 and the seat backs 113 may be provided with an angled top side, while the straight corner back 116 does not include the angled top side.

Figure 7B:
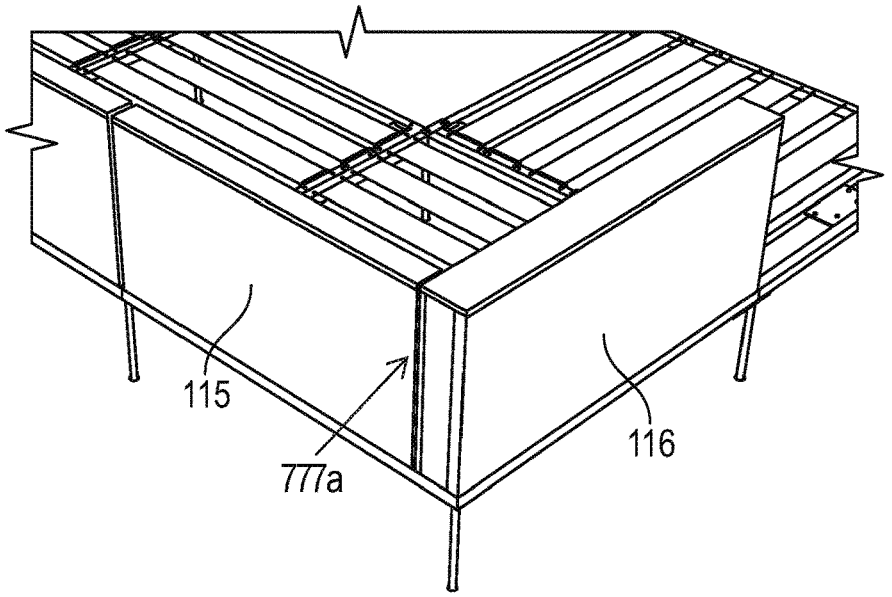
FIG. 7B depicts a rear perspective view of a furniture unit assembled from a modular furniture system having a horizontal framework, an angled corner back, and a straight corner back, according to an aspect.

FIG. 7B depicts a rear perspective view of a furniture unit assembled from a modular furniture system having a horizontal framework, an angled corner back 115, and a straight corner back 116, according to an aspect. The straight sides of the straight corner back 116 can be used to ensure that there is no visible gap at point 777*a* along the back of the sofa in between the angled corner back 115 and the straight corner back 116.

Figure 7C:
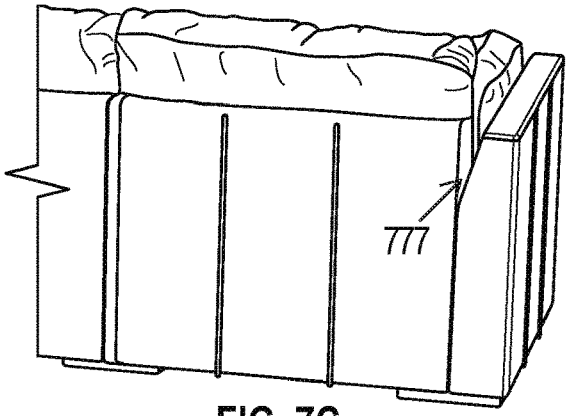
FIG. 7C depicts a rear view of an exemplary sofa that does not utilize a straight-sided back as shown in FIG. 7B, according to an aspect.

FIG. 7C depicts a rear view of an exemplary sofa that does not utilize a straight-sided back as shown in FIG. 7B, according to an aspect. A visible gap 777 can appear between the back pieces of the sofa without the use of a straight corner back as shown in FIGS. 7A-7B.

Figure 8A:
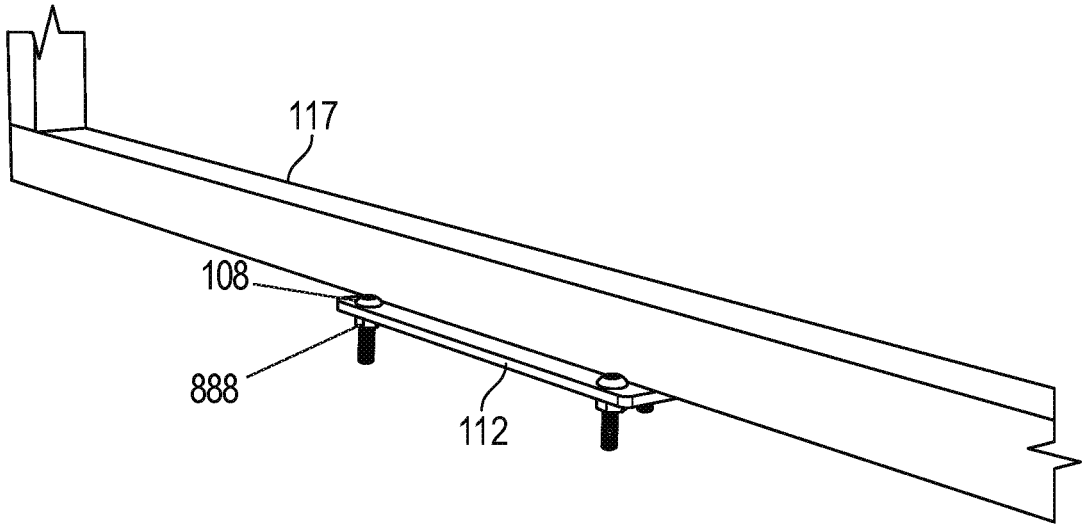
FIGS. 8A-8B depict a vertical support frame having a mating plate, and an enlarged detailed view of the coupling between a vertical support frame and a horizontal support frame, respectively, according to an aspect.
Figure 8B:
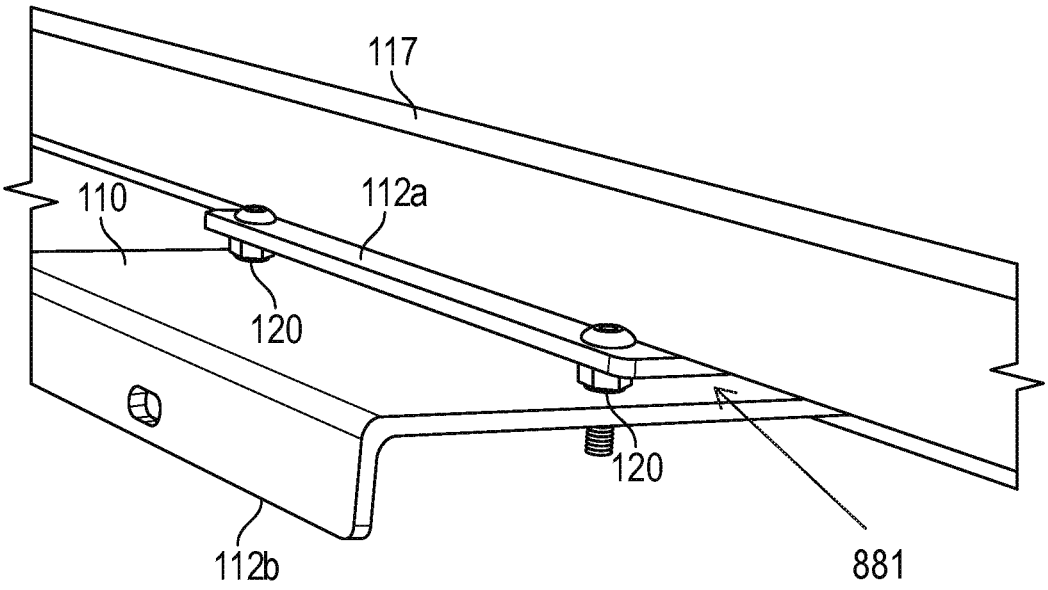

FIGS. 8A-8B depict a vertical support frame 117 having a mating plate 112, and an enlarged detailed view of the coupling between a vertical support frame 117 and a horizontal support frame 110, respectively, according to an aspect. Also shown are a bolt 108 and a locknut 888 for securing these components together.

Generally, for coupling together a vertical support frame and a horizontal support frame, the mating plates of each frame are used. In some embodiments, the system is provided with two mating plates with matching hole patterns, with a first mating plate on the vertical frame 112*a* and a second mating plate 112*b* on the horizontal frame. The mating plates may be welded to the frames. In some embodiments, on the vertical frame, a thread is attached to the mating plate and extends outwards. A spacer is attached on the bottom side of the plate to create a gap for the cover and the zipper of the upholstery of the modular furniture system. These spacers may rest against the horizontal frame mating plate. The threads go through the matching holes on the mating plate of the horizontal frame, such that a nut 120 can be installed to attach the two frames together. In some embodiments, the spacers are locknuts. In some embodiments, the spacers are regular nuts if threads are provided welded onto the plate or other pieces of the module.

In some embodiments, a bolt can be placed through each hole of the mating plates, bolted with a locknut, with the head of the bolt facing upwards, and the thread facing downwards. The locknuts may rest on the mating plate of the horizontal frame in order to leave a gap 881 for the zipper. In some embodiments, bolts or threads may be welded directly to the plate, such that regular nuts or spacers can be used to create the gap for the zipper. In some embodiments, the upholstery of the modular furniture system comprises holes for the nuts and threads to pass through.

Figure 9A:
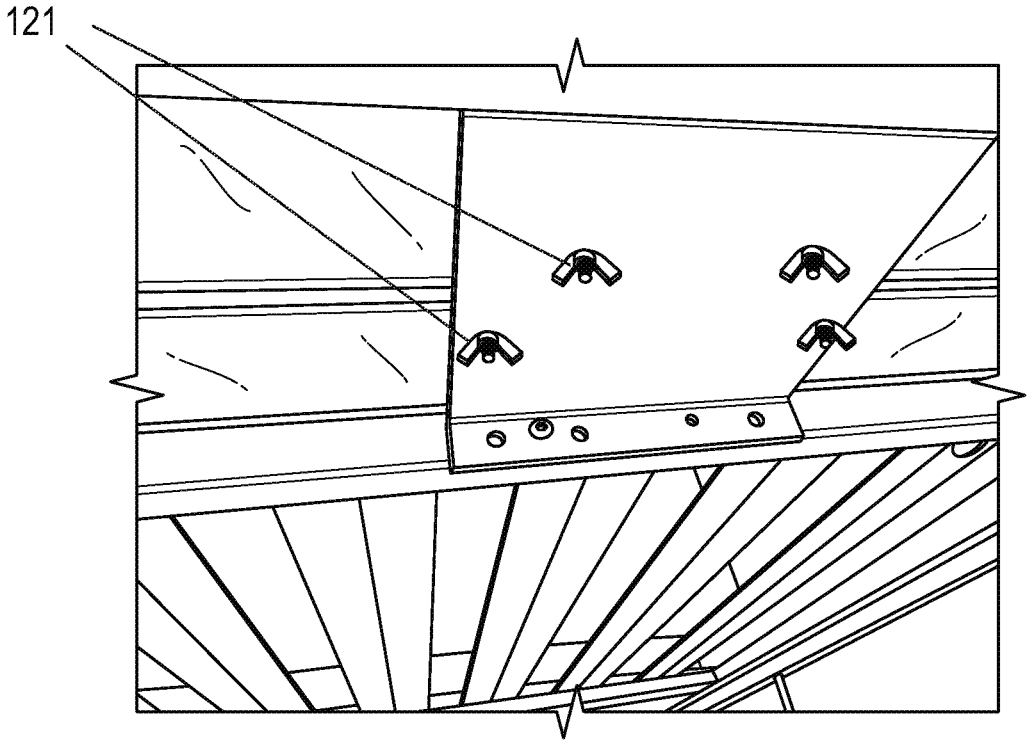
FIG. 9A depicts a bottom perspective view of a coupling between a vertical panel and a horizontal panel with nuts, according to an aspect.

FIG. 9A depicts a bottom perspective view of a coupling between a vertical panel and a horizontal panel with nuts, according to an aspect. Wingnuts 121 may be provided to allow for an installation without tools, for example.

Figure 9B:
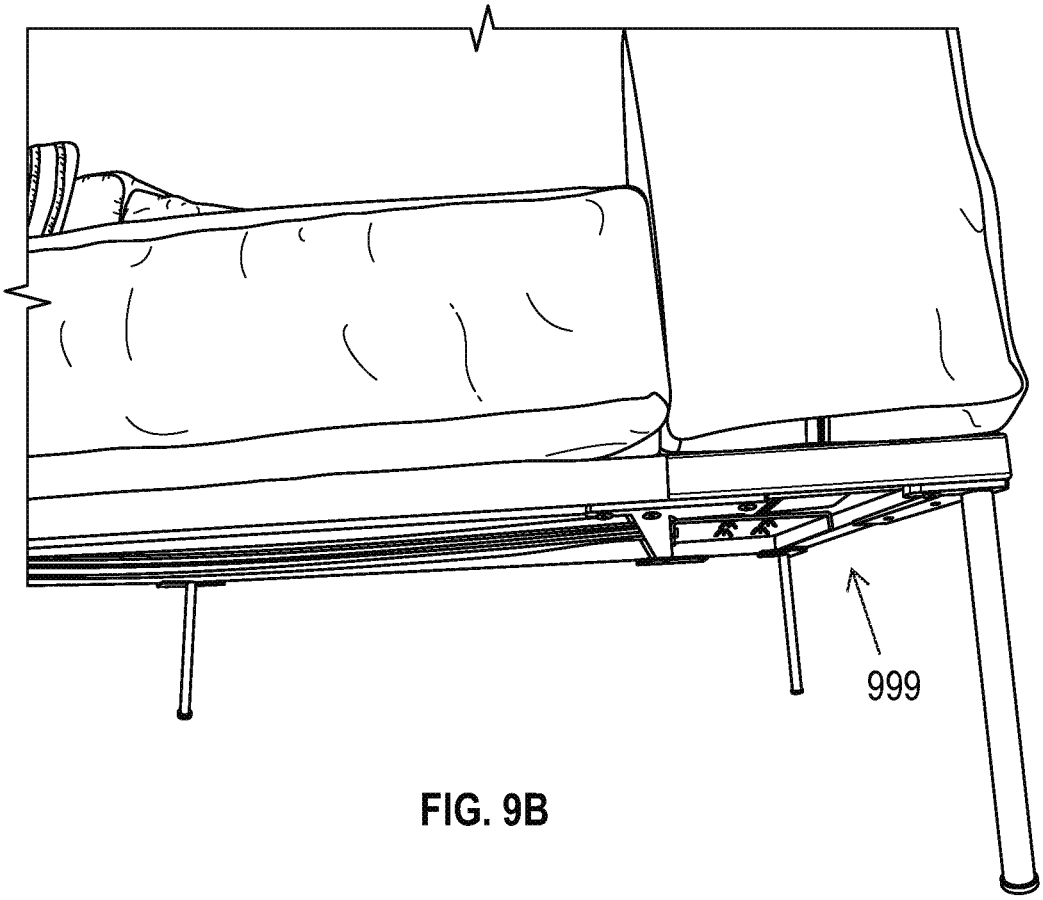
FIGS. 9B-9C show a front view and a front, bottom perspective view, respectively, of a coupling between a vertical panel and a horizontal panel as viewed on an assembled furniture unit, according to an aspect.
Figure 9C:
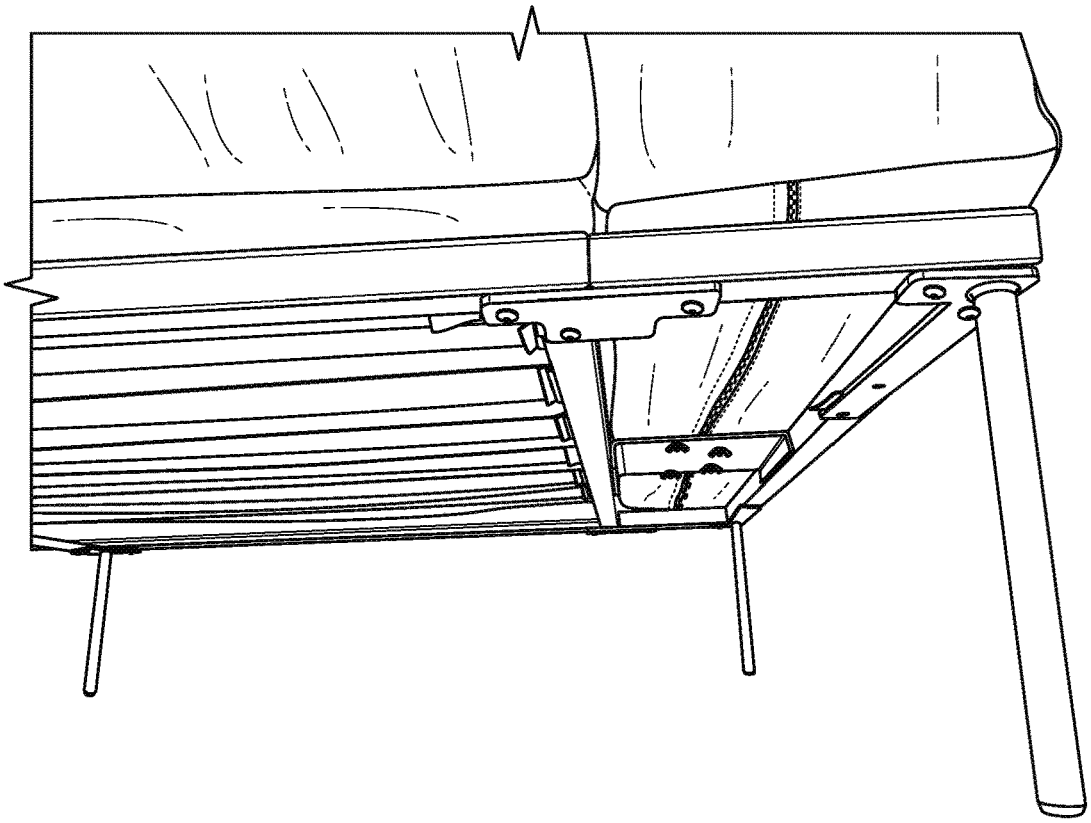

FIGS. 9B-9C show a front view and a front, bottom perspective view, respectively, of a coupling between a vertical panel and a horizontal panel as viewed on an assembled furniture unit, according to an aspect. The arrow indicating area 999 in FIG. 9B indicates the region shown as an enlarged detailed view in FIG. 9A.

Figure 10:
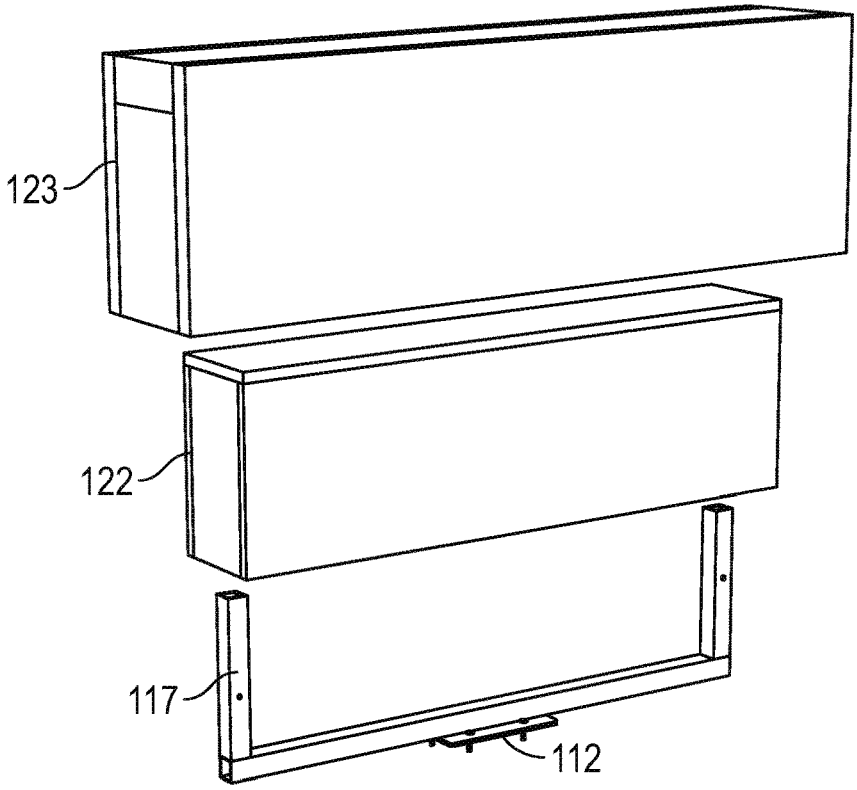
FIG. 10 depicts an exploded view of the components of an exemplary vertical panel of the modular furniture system, according to an aspect.

FIG. 10 depicts an exploded view of the components of an exemplary vertical panel of the modular furniture system, according to an aspect. The vertical panel shown in FIG. 10 as an example is an armrest. Generally, the vertical units or modules of the modular furniture system may be provided in different shapes and forms, but may be provided with similar construction. For example, the vertical units can include a metal vertical frame 117 having a mating plate 112, a wood box 122 screwed on top of the metal frame, and a foam box 123. The foam box may be constructed from upholstery foam, and it may slide on top of the wood frame. The wood box may be constructed from any suitable lightweight and sturdy wood, or other suitable sturdy or rigid material. Additionally, an upholstery cover such as a fabric cover or leather cover may wrap around the foam box, wood box, and metal frame.

FIGS. 11A-11H depict steps of an exemplary process for assembling a module of the modular furniture system, according to an aspect. In some embodiments, a vertical module may be assembled generally as follows. First, the foam box is placed inside the upholstery cover. Next, the metal frame and wood box, which may be provided being screwed together, are slid into the foam box and cover. Next, the threads and nuts are routed through the holes in the upholstery cover. Lastly, the upholstery cover is zipped shut.

Figure 11A:
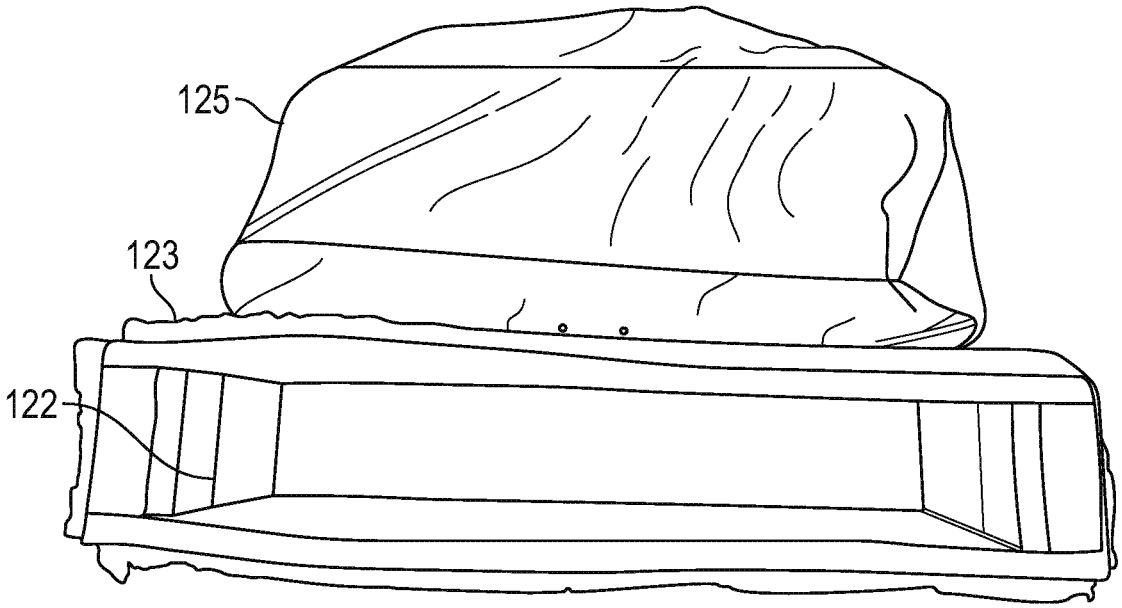
FIGS. 11A-11H depict steps of an exemplary process for assembling a module of the modular furniture system, according to an aspect.
Figure 11B:
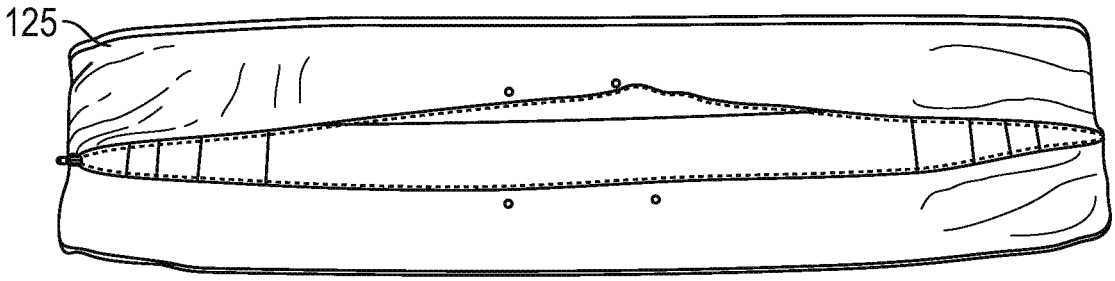
Figure 11C:
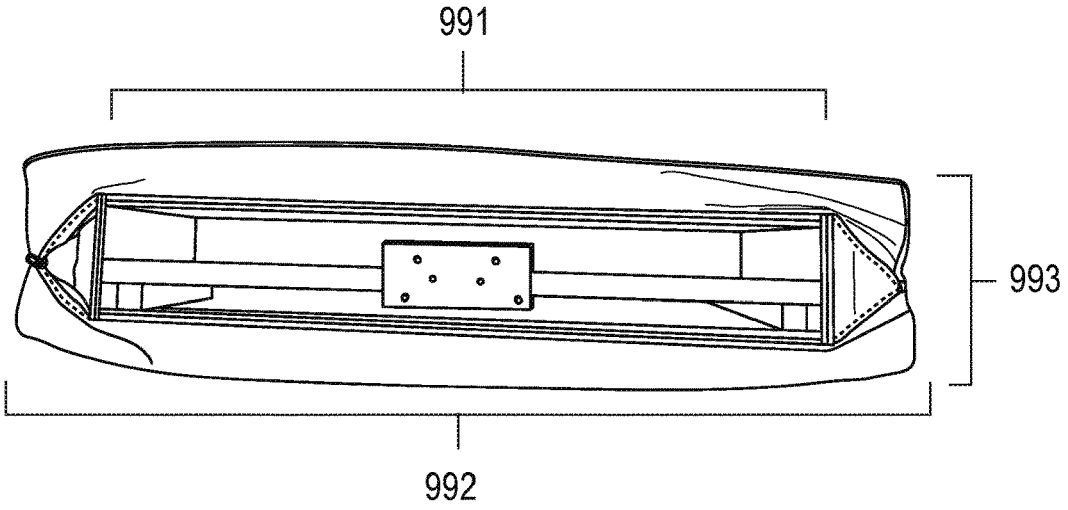

FIG. 11A shows an upholstery cover 125 and a foam box 123 over a wood box 122. FIG. 11B shows the foam box being placed inside of the upholstery cover 125. FIG. 11C shows the metal frame and wood box, which are screwed together, slid inside the foam box and cover. The wood box may be shorter than the cover to fit through the zipper of the cover. As an example, exemplary dimensions are provided in FIG. 11C. For example, the cover width 993 may be 7 inches, and the cover length 992 may be 35 inches long, and the wood box length 991 may be 29 inches long, such that there is 3 inches of foam on both ends. The wider the cover, the shorter the box should be. For every two inches of cover width, approximately 1 inch of foam box length should be added on both ends. As another example, if the cover is approximately 35"×4", at least 2" of foam is provided on both ends, and the wood box is at least approximately 31" long. It should be understood that the dimensions may be provided in any suitable size and shape for the modular furniture system, and that the dimensions provided herein are merely examples.

Figure 11D:
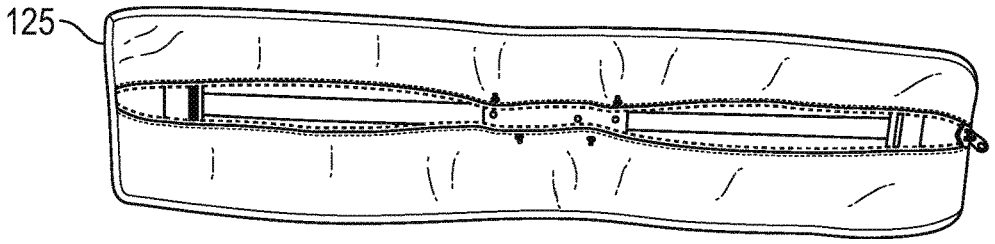
Figure 11E:
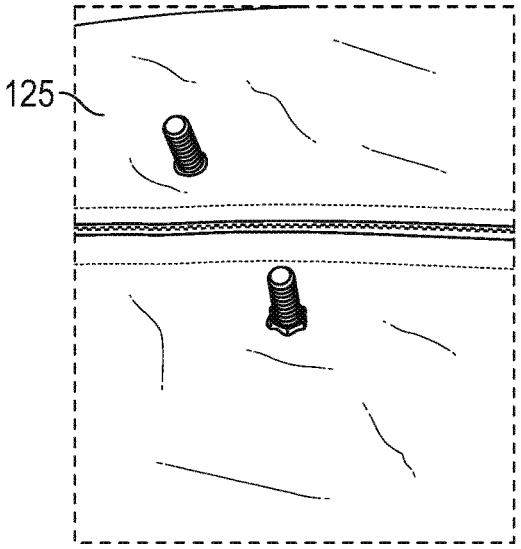
Figure 11F:
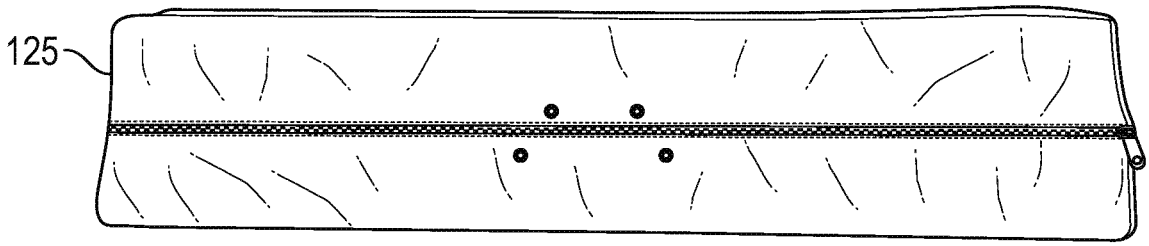
Figure 11G:
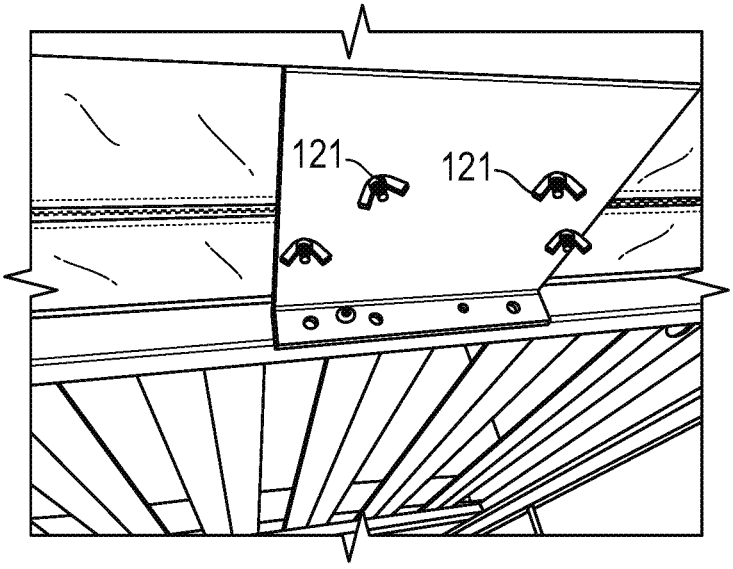
Figure 11H:
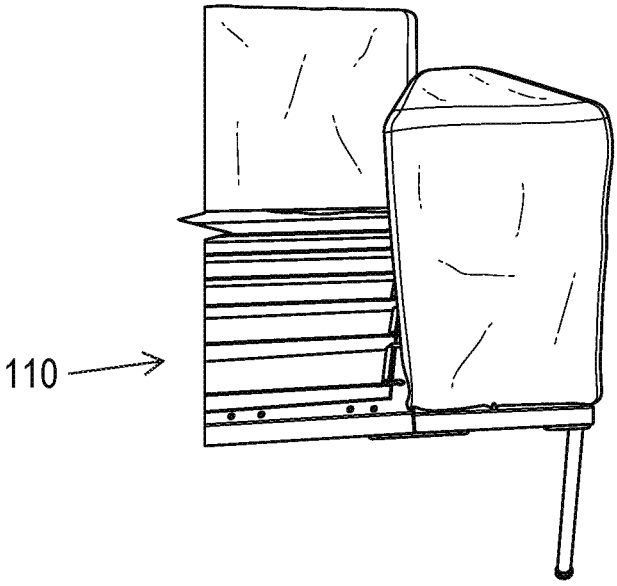

FIG. 11D shows the threads and nuts passing through the holes of the upholstery cover 125. FIG. 11E shows an enlarged detailed view of the threads passing through the upholstery cover 125. FIG. 11F shows the zipper of the upholstery cover 125 zipped shut. FIG. 11G shows the armrest vertical panel being attached to the horizontal frame with wing nuts 121. FIG. 11H shows a portion of a sofa assembled from modules of the modular furniture system using the steps depicted in FIGS. 11A-11G. For visual clarity, such that the suspension system 110 can be seen, seat cushions are omitted from the view depicted in FIG. 11H.

Figure 12A:
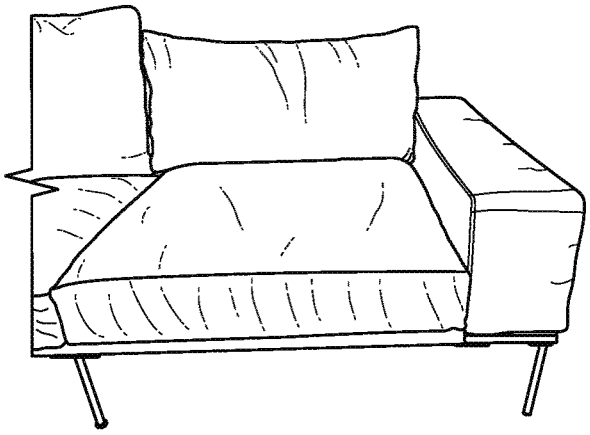
FIGS. 12A-12C depict a partial front, partial side perspective, and partial top view, respectively, of an example of a fully assembled sofa using modules of the modular furniture systems provided herein, according to an aspect.
Figure 12B:
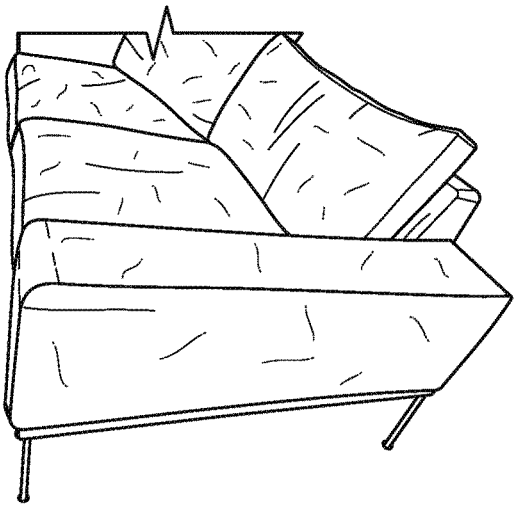
Figure 12C:
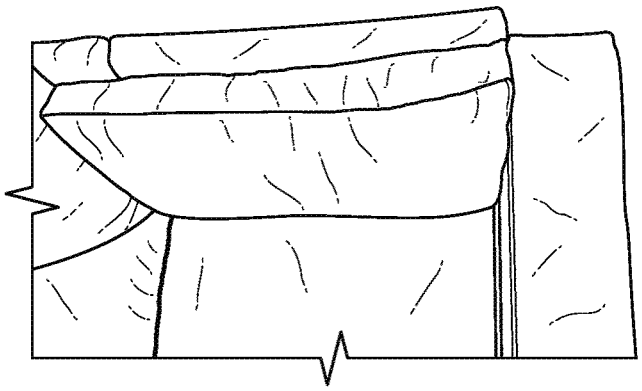

FIGS. 12A-12C depict a partial front, partial side perspective, and partial top view, respectively, of an example of a fully assembled sofa using modules of the modular furniture systems provided herein, according to an aspect. Seat cushions and upholstery are depicted in these views.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A modular furniture system for assembling a furniture unit into a desired configuration, comprising:

a plurality of modules, comprising:

a plurality of horizontal modules, each one of the horizontal modules comprising:

a horizontal frame;

a suspension system having a plurality of straps extending from a first end to a second end of the horizontal frame; each strap of the plurality of straps being connected to the first end via a first hook and connected to the second end via a second hook;

a plurality of feet extending from the horizontal frame; and at least one horizontal frame mating plate;

a plurality of vertical modules, each one of the vertical modules comprising:

a vertical frame;

a wood box configured to partially surround the vertical frame;

a foam box configured to partially surround the vertical frame and the wood box; and at least one vertical frame mating plate;

wherein the wood box and the foam box comprise openings for exposing the at least one vertical frame mating plate when the wood box and the foam box are surrounding the vertical frame; and a coupling system for attaching any one of the modules to any other one of the modules of the plurality of modules; the coupling system comprising:

a plurality of brackets, each bracket comprising a plurality of oval holes;

a plurality of bolts configured to be received into the brackets and attach the brackets to the horizontal frame or the vertical frame;

wherein the horizontal frame mating plate and the vertical frame mating plate of each one of the horizontal modules and each one of the vertical modules are capable of connecting and securing to a second horizontal frame mating plate or a second vertical frame mating plate.

2. The modular furniture system of claim 1, wherein the horizontal frame mating plate comprises a first surface, and a second surface perpendicular to the first surface.

3. The modular furniture system of claim 1, wherein the vertical frame mating plate comprises a first surface, and a second surface perpendicular to the first surface.

4. The modular furniture system of claim 1, wherein the plurality of horizontal modules comprises an armrest unit.

5. The modular furniture system of claim 1, wherein the plurality of vertical modules comprises an angled corner back unit.

6. The modular furniture system of claim 5, wherein the angled corner back unit comprises an angled top side.

7. The modular furniture system of claim 1, wherein the plurality of vertical modules comprises a straight corner back unit.

8. The modular furniture system of claim 1, wherein the horizontal mating plate is attached to the horizontal frame on a first side and attached to the vertical mating plate on a second side, and wherein the vertical mating plate is attached to the vertical frame, and wherein the attachment of the horizontal mating plate to the vertical mating plate is accomplished by bolts threaded through the horizontal mating plate and the vertical mating plate.

9. The modular furniture system of claim 8, wherein the bolts threaded through the horizontal mating plate and the vertical mating plate are threaded via wingnuts.

10. A modular furniture system for assembling a furniture unit into a desired configuration, comprising:

a plurality of horizontal modules, each one of the horizontal modules comprising:

a horizontal frame;

a suspension system having straps extending from a first end to a second end of the horizontal frame and being connected to the first end and the second end via a plurality of attachment points; and at least one horizontal frame mating plate;

a plurality of vertical modules, each one of the vertical modules comprising:

a vertical frame;

a rigid box configured to surround the vertical frame;

a foam box configured to surround the vertical frame and the rigid box; and at least one vertical frame mating plate on the vertical frame;

wherein the rigid box and the foam box comprise openings for exposing the at least one vertical frame mating plate when the rigid box and the foam box are surrounding the vertical frame;

wherein the horizontal frame mating plate and the vertical frame mating plate of each one of the horizontal modules and each one of the vertical modules are capable of connecting and securing to a second horizontal frame mating plate or a second vertical frame mating plate.

11. The modular furniture system of claim 10, wherein the horizontal frame mating plate comprises a first surface, and a second surface perpendicular to the first surface.

12. The modular furniture system of claim 10, wherein the vertical frame mating plate comprises a first surface, and a second surface perpendicular to the first surface.

13. The modular furniture system of claim 10, wherein the plurality of horizontal modules comprises an armrest unit.

14. The modular furniture system of claim 10, wherein the plurality of vertical modules comprises an angled corner back unit.

15. The modular furniture system of claim 10, wherein the plurality of vertical modules comprises a straight corner back unit.

16. The modular furniture system of claim 10, wherein the horizontal mating plate is attached to the horizontal frame on a first side and attached to the vertical mating plate on a second side, and wherein the vertical mating plate is attached to the vertical frame, and wherein the attachment of the horizontal mating plate to the vertical mating plate is accomplished by bolts threaded through the horizontal mating plate and the vertical mating plate.

17. A method of providing a modular furniture system for assembling a furniture unit into a desired configuration, the method comprising:

providing modules, wherein each one of the modules is configured to fit with any one of each of the other modules, the modules comprising:

a plurality of horizontal modules, each one of the horizontal modules comprising:

a horizontal frame;

a suspension system having straps extending from a first end to a second end of the horizontal frame and being connected to the first end and the second end via a plurality of hooks;

a plurality of feet extending from the horizontal frame; and at least one horizontal frame mating plate;

a plurality of vertical modules, each one of the vertical modules comprising:

a vertical frame;

a wood box configured to surround the vertical frame;

a foam box configured to surround the vertical frame and the wood box; and at least one vertical frame mating plate on the vertical frame;

wherein the wood box and the foam box comprise openings for exposing the at least one vertical frame mating plate when the wood box and the foam box are surrounding the vertical frame;

wherein the horizontal frame mating plate and the vertical frame mating plate of each one of the horizontal modules and each one of the vertical modules are capable of connecting and securing to a second horizontal frame mating plate or a second vertical frame mating plate.

18. The method of claim 17, wherein the horizontal mating plate is attached to the horizontal frame on a first side and attached to the vertical mating plate on a second side, and wherein the vertical mating plate is attached to the vertical frame, and wherein the attachment of the horizontal mating plate to the vertical mating plate is accomplished by bolts threaded through the horizontal mating plate and the vertical mating plate.

19. The modular furniture system of claim 17, wherein the horizontal frame mating plate comprises a first surface, and a second surface perpendicular to the first surface.

20. The modular furniture system of claim 17, wherein the vertical frame mating plate comprises a first surface, and a second surface perpendicular to the first surface.

* * * * *